US012246371B1

(12) United States Patent
Everts et al.

(10) Patent No.: US 12,246,371 B1
(45) Date of Patent: Mar. 11, 2025

(54) PULL TAB WITH RAISED LIFT END AND ASSOCIATED METHOD

(71) Applicant: Intellectual Capital Management, Whitefish, MT (US)

(72) Inventors: Mitchell Everts, Whitefish, MT (US); Andrew Hogenkamp, Minster, OH (US)

(73) Assignee: Intellectual Capital Management, Whitefish, MT (US)

( * ) Notice: Subject to any disclaimer, the term of this patent is extended or adjusted under 35 U.S.C. 154(b) by 0 days.

(21) Appl. No.: 18/829,257

(22) Filed: Sep. 9, 2024

Related U.S. Application Data

(60) Provisional application No. 63/537,633, filed on Sep. 11, 2023.

(51) Int. Cl.
*B21D 51/38* (2006.01)

(52) U.S. Cl.
CPC ..... *B21D 51/383* (2013.01)

(58) Field of Classification Search
CPC ..... B21D 51/383
USPC ..... 413/12, 14–17
See application file for complete search history.

(56) References Cited

U.S. PATENT DOCUMENTS

| | | | | |
|---|---|---|---|---|
| 3,313,446 | A | 4/1967 | Harvey | |
| 3,437,229 | A | 4/1969 | Khoury | |
| 3,863,801 | A | 2/1975 | Pillnik | |
| 3,923,193 | A | 12/1975 | Wells | |
| 3,938,696 | A | 2/1976 | Herbst | |
| 3,967,752 | A | 7/1976 | Cudzik | |
| 5,699,928 | A | 12/1997 | Chung | |
| D432,015 | S | 10/2000 | Holiday | |
| D579,771 | S | 11/2008 | Cherian | |
| 7,617,945 | B2 | 11/2009 | Cherian | |
| 8,733,576 | B2 | 5/2014 | Jeon | |
| 9,511,411 | B2 | 12/2016 | Tielbeke | |
| 10,710,766 | B2 | 7/2020 | Tashiro | |
| 2005/0039314 | A1* | 2/2005 | Dickie | B21D 51/383 29/418 |

(Continued)

FOREIGN PATENT DOCUMENTS

| | | | |
|---|---|---|---|
| CN | 101522534 | B | 9/2009 |
| CN | 204210862 | U | 3/2015 |

(Continued)

*Primary Examiner* — Mohammed S. Alawadi
(74) *Attorney, Agent, or Firm* — QuickPatents; Kevin Prince

(57) ABSTRACT

A progressive die manufacturing method for producing pull tabs with raised lift ends for beverage containers utilizes an ear carry process, producing tab blanks from a carrier sheet fixed by carrier strips at attachment points. At a tab station, blanks are formed into pull tabs with specific features including a nose, rivet receiving portion, lift portion, and preferably a finger hole. A lift station creates deformations elevating the lift portion relative to a highest continuous surface of the pull tab, prior to any deformations or bends. The carrier strips are then cut to release the finished pull tabs. Optional enhancements include an integrated or modular lift station, specific bending angles and distances, and a center bar for indicia application. This method combines the benefits of the ear carry process with improved ergonomics, enhancing user experience while minimizing machinery modifications.

20 Claims, 8 Drawing Sheets

(56) References Cited

U.S. PATENT DOCUMENTS

| | | | | |
|---|---|---|---|---|
| 2005/0224497 | A1 | 10/2005 | Wook | |
| 2006/0163254 | A1 | 7/2006 | Wichelhaus | |
| 2008/0173646 | A1 | 7/2008 | Wang | |
| 2010/0326281 | A1 | 12/2010 | Nishibe et al. | |
| 2011/0253719 | A1 | 10/2011 | Cherian | |
| 2012/0273492 | A1 | 11/2012 | Werth et al. | |
| 2013/0075401 | A1* | 3/2013 | Forrest | G09F 23/0091 413/56 |
| 2015/0239607 | A1 | 8/2015 | Fields | |
| 2018/0099777 | A1 | 4/2018 | Cohen Bissu | |
| 2021/0300621 | A1 | 9/2021 | Ohkoshi | |
| 2023/0150722 | A1* | 5/2023 | Chiji | B21D 51/44 220/269 |

FOREIGN PATENT DOCUMENTS

| | | | |
|---|---|---|---|
| JP | 2001199441 | A | 7/2001 |
| KR | 19990008275 | U | 2/1999 |
| KR | 200174367 | Y1 | 3/2000 |
| KR | 200307673 | Y1 | 3/2003 |
| KR | 200382944 | Y1 | 4/2005 |
| KR | 100487015 | B1 | 5/2005 |
| KR | 20120138405 | A | 12/2012 |
| KR | 20150001607 | U | 4/2015 |
| KR | 20160020948 | A | 2/2016 |

* cited by examiner

PULL TAB WITH RAISED LIFT END AND ASSOCIATED METHOD

CROSS REFERENCE TO RELATED APPLICATIONS

This application claims the benefit of U.S. Provisional Patent Application 63/537,633, filed on Sep. 11, 2023, and incorporated herein by reference.

STATEMENT REGARDING FEDERALLY SPONSORED RESEARCH AND DEVELOPMENT

Not Applicable.

FIELD OF THE INVENTION

This invention relates to pull tabs for beverage containers, and more particularly to a method of manufacturing pull tabs with raised lift ends using an ear carry progressive die technique.

BACKGROUND

The pull tab has remained an integral component in the beverage industry, offering consumers a swift and straightforward mechanism to access their beverages. Over the years, its design has undergone multiple revisions, primarily driven by the need to enhance user experience, environmental considerations, and cost-effective production.

A pivotal advancement in pull tab design is the incorporation of a raised lift end, which offers users enhanced space for easy finger insertion, thereby simplifying the can opening experience. This elevated section of the pull tab is designed to sit higher than its main body, creating additional clearance between the tab and the beverage can lid.

While this design offers notable benefits, its typical manufacturing approach, especially the nose carry progressive die technique, presents challenges. In particular, adapting current machinery for nose carry methods often proves costly and intricate. While there are a few existing elevated lift-end pull tabs in the industry that utilize nose carry methods, the majority of pull tabs are produced using ear carry for flat tabs. Switching a conversion press from ear carry to nose carry requires a significant retrofitting process, which involves reconfiguring the tooling and adjusting the press for the new carrier strip positions. By maintaining ear carry and adding change tooling to produce an elevated lift-end pull tab, the cost and downtime associated with retrofitting are greatly reduced.

Given the predominant use of the ear carry process in the industry, which utilizes the back or lift portion of the tab to transport it through the manufacturing line, there exists a need for a method that combines the ergonomic advantages of a raised lift end pull tab with the efficiency and minimal retrofitting demands of the ear carry manufacturing method. Such a needed invention would allow for the production of pull tabs with enhanced user accessibility while utilizing existing machinery infrastructure, avoiding costly and intricate adaptations required for nose carry methods. The present invention accomplishes these objectives.

SUMMARY OF THE INVENTION

This invention relates to a progressive die manufacturing method, such as for producing pull tabs used in opening containers such as aluminum beverage cans. The methods introduce an innovative approach to creating pull tabs with a raised lift end, enhancing user accessibility while ensuring efficient manufacturability.

This invention pertains to a method of manufacturing pull tabs for beverage containers using various components of a conversion press system, including but not limited to a tab station, lane die, bridge guide, or modular lift station. Additionally, the process can be applied to tabs produced on separate machinery and later attached to the lids of containers. The method described herein is applicable to both tapered and non-tapered pull tab designs, ensuring flexibility in the application of the described manufacturing process. The lift stations are integrated into the tab die through a retrofitting process, wherein change tooling is installed to create the upward bends that elevate the lift portion of the pull tab. This retrofitting can be implemented either within the reform station or other stations of the tab die, providing flexibility in the manufacturing process. The primary advantage of this integration is the ability to utilize existing conversion press systems, minimizing costs and downtime by avoiding a complete overhaul of the machinery.

The process begins with producing at least one tab blank from a carrier sheet in a progressive die stamping process. Each tab blank is fixed with the carrier sheet at one or more attachment points via carrier strips. Carrier strips are affixed to one or more attachment points located within the top half of the pull tab, including but not limited to areas surrounding the finger hole and extending to the topmost point of the lift portion. The top half of the pull tab is defined as the region in proximity to the finger hole. The invention specifically protects manufacturing methods that utilize processes that attach carrier strips in this region. In a preferred embodiment, the attachment points are contained to the lift portion of the tab in proximity to the finger hole. Within a progressive manufacturing system these blanks are formed into pull tabs with specific features: a nose for applying pressure to a container lid's frangible region, a rivet receiving portion with an aperture, a lift portion extending from the nose and terminating at a distal end, and preferably a finger hole located in proximity to the lift portion.

A key innovation in this method is the use of a lift station where the pull tab is bent to create deformations such that the lift portion is elevated relative to a top plane of the pull tab. The top plane of the pull tab refers to the highest continuous surface that runs along the length of the pull tab from the nose to the lift portion, prior to any deformations or bends. The structural deformations are intentional features that protrude above the top plane to elevate the lift portion for improved user interaction. This bending process creates the raised lift end. The carrier strips are then cut from the attachment points of each pull tab to release the finished pull tabs from the carrier sheet. Subsequently each pull tab is then fixed with the container lid that is thereafter fixed with a container.

The method offers several optional enhancements. The lift station may be integrated within a reform station, within a tab station, lane die, bridge guide, or designed as a modular, interchangeable, or separate system for manufacturing flexibility. The lift station is modular and interchangeable, allowing for change tooling to be transferred between the reform station and other stations within the tab die. This modularity is achieved through a simple retrofitting process, where the interchangeable tooling is designed for high-speed manufacturing while maintaining the necessary accuracy for creating upward bends in the pull tab. By enabling a straightforward installation of alternate lift stations, the method ensures flexibility in the manufacturing process. The bending angles are between 1 and 80 degrees, preferably between 40 and 50 degrees. This range allows for optimal tooling longevity and manufacturability. At sharper angles, the tooling in the conversion press is subject to more rapid wear, which could decrease manufacturing speed and efficiency. By adjusting the angle to an optimal range, the method allows for elevated lift tabs to be produced while preserving tooling over long production runs, thus supporting high-speed manufacturing. The bending angles can be located at specific distances from the lift portion's distal end, usually between 1 mm and 10 mm, optimizing user interaction and structural integrity.

In some embodiments, the lift station bends the pull tab to create deformations at two opposing sides of the finger hole, elevating the lift portion above the plane of the pull tab by a distance sufficient to enhance user access and stacking compatibility, typically between 1 mm to 10 mm.

Additional features may include forming a center bar of the pull tab disposed between the nose and the lift portion. The center bar of the pull tab has a preferred thickness of at least 1.9 mm. This dimension ensures that sufficient surface area is available on the center bar for the application of promotional material or insignia. The topmost point of the center bar to the bottommost point provides a vertical dimension large enough for effective stamping, laser etching, or other means of insignia application. An indicia may be applied to this center bar, which can include branding, instructions, or other relevant information.

The manufacturing process can involve multiple stations, with the carrier sheet and pull tabs moving between the tab station, lift station, and cutting station.

This method uniquely combines the benefits of the ear carry process, which utilizes much of the existing progressive die infrastructure, with the improved ergonomics of a raised lift end. The result is a pull tab design that enhances user experience while minimizing the need for extensive machinery modifications in production.

By utilizing this innovative progressive die technique, the present invention produces pull tabs with enhanced user accessibility while utilizing much of existing machinery infrastructure, avoiding costly and intricate adaptations required for alternative methods. This novel approach not only addresses the ergonomic concerns of traditional pull tabs but also provides a cost-effective solution for manufacturers, seamlessly integrating improved design with established production processes. The present invention thus represents a significant advancement in pull tab manufacturing, offering a harmonious blend of user-centric design and manufacturing efficiency.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number, respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
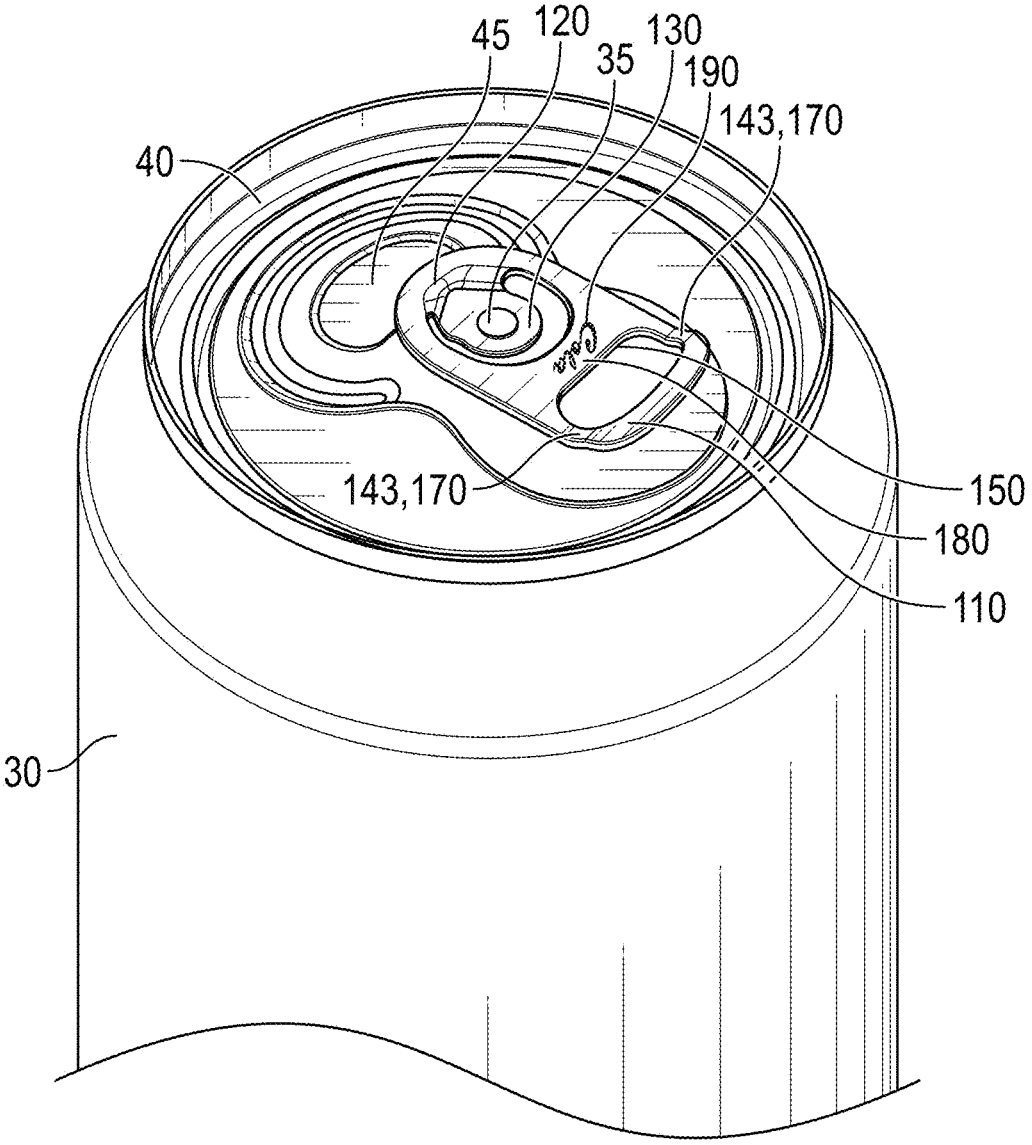
FIG. 1 is a top rear perspective view of a pull tab produced by a method of the present invention, illustrated as affixed with a container lid of a container.
Figure 2:
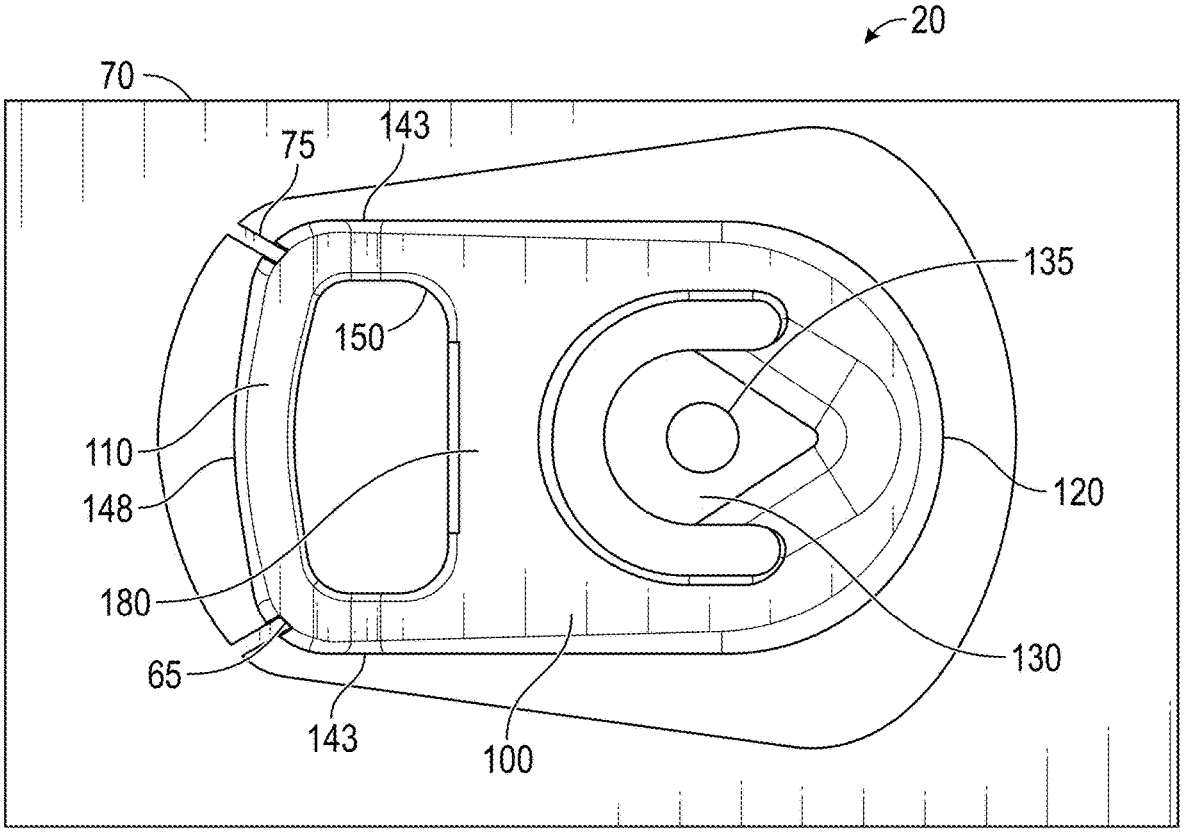
FIG. 2 is a top plan view of a pull tab of the present invention, illustrated as stamped from a carrier sheet and connected to the carrier sheet with a pair of carrier strips.
Figure 3:
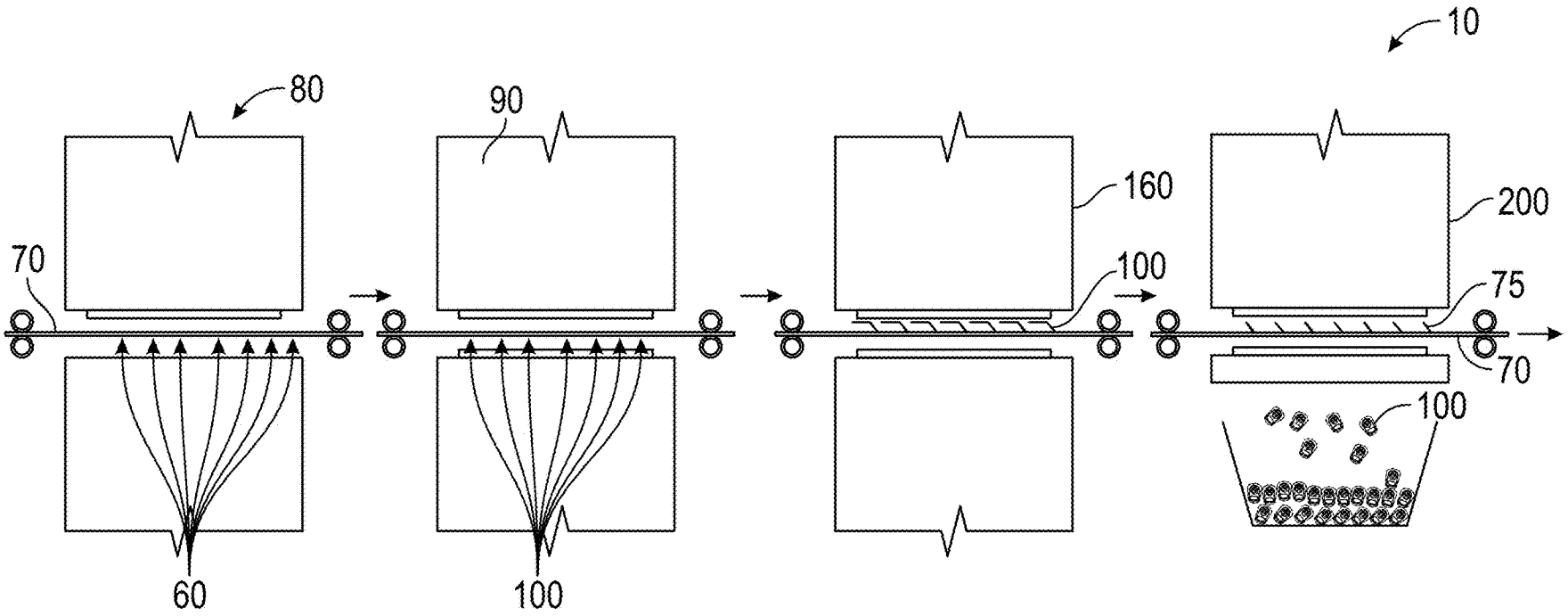
FIG. 3 is a diagram of a method of the present invention, illustrating a carrier sheet that is formed into a plurality of tab blanks and then pull tabs at various manufacturing stations.
Figure 4:
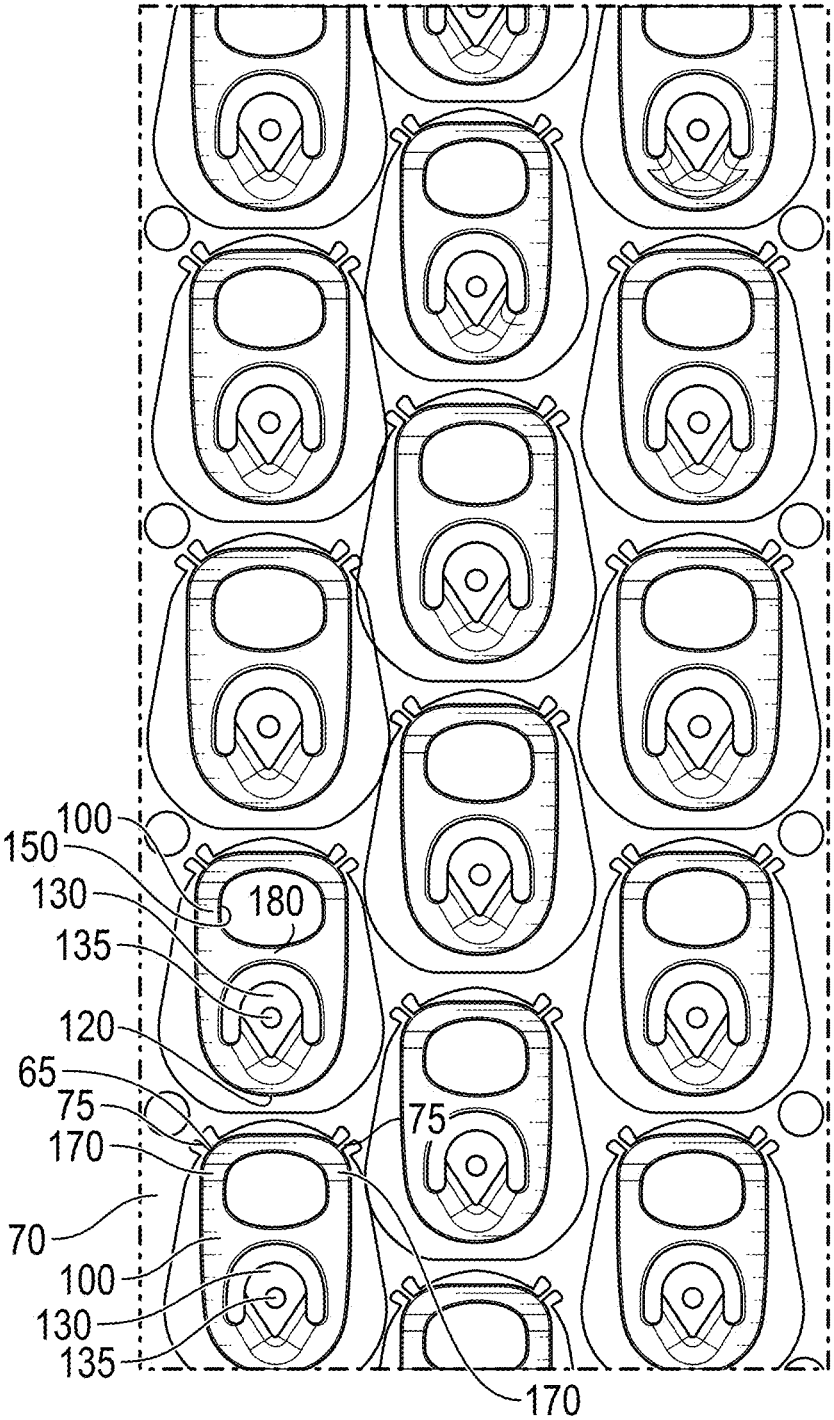
FIG. 4 is a top plan view of the carrier sheet showing the plurality of formed pull tabs just before the pull tabs are cut away from the carrier sheet at attachment points of the pull tabs.
Figure 5:
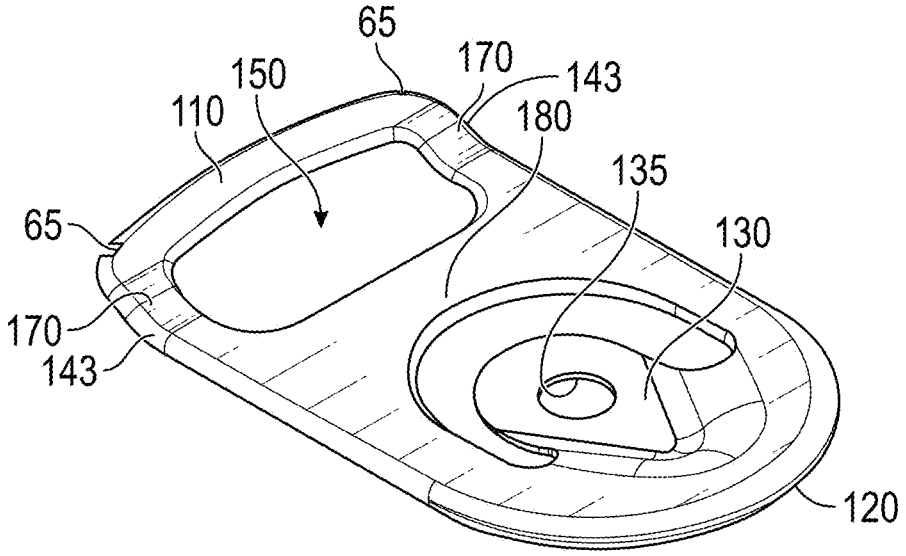
FIG. 5 is a top front perspective view of the pull tab once cut away from the carrier sheet.

FIGS. 1-3 illustrate a progressive die manufacturing method 10 of producing a pull tab 20 for opening a container 30 of the type having a frangible region 45 of a container lid 40 and a rivet 35 (FIG. 8) adjacent the frangible region 45. The method 10 comprises producing at least one tab blank 60 from a carrier sheet 70 in a first die stamping process 80, as shown in FIG. 3. Each tab blank 60 is fixed with one or more carrier strips 75 of the carrier sheet 70 at one or more attachment points 65 on the pull tab 20 (FIGS. 2 and 4). The carrier sheet 70 and associated tab blanks 60 are typically made of aluminum, tin, or steel, with the most common grade being aluminum 5182-H19 or H32. These materials are selected for their balance of durability and manufacturability, but other grades of aluminum, tin, or steel can be utilized depending on the specific requirements of the manufacturing process.

At a subsequent tab stations 90, each tab blank 60 is formed into a pull tab 100 having a nose 120 configured to apply downward pressure on the frangible region 45 of the container lid 40, as illustrated in FIGS. 1 and 2. Such a pull tab 100 also includes a rivet receiving portion 130 adjacent to the nose 120 that includes a rivet aperture 135 therethrough. A lift portion 110 is disposed distally from the nose 120 and terminates at a distal end 148 of the pull tab 100.

Each attachment point 65 is disposed at the lift portion of each pull tab 100. Each lid 40 may further include a recessed area 27 (FIG. 8) aligned with the lift portion 110 when assembled that provides even more space for a user's fingers to grasp the pull tab 100.

Figure 7:
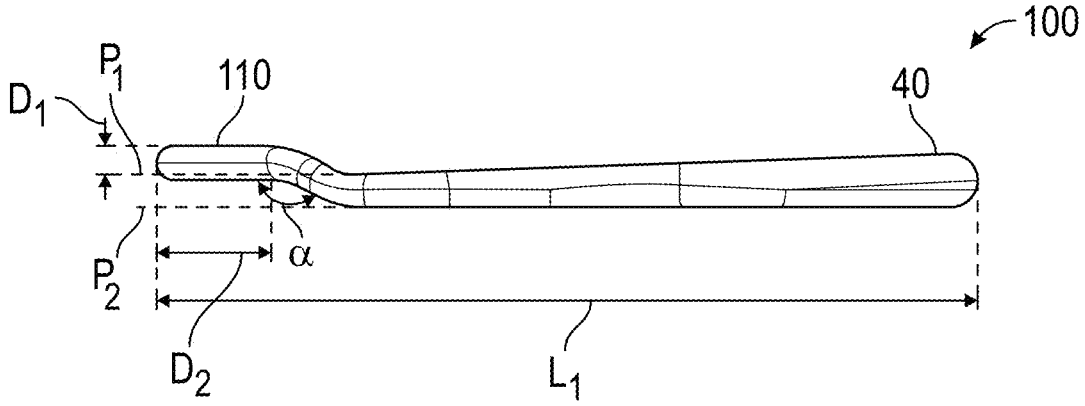
FIG. 7 is a side elevational view of the pull tab of FIG. 6.
Figure 8:
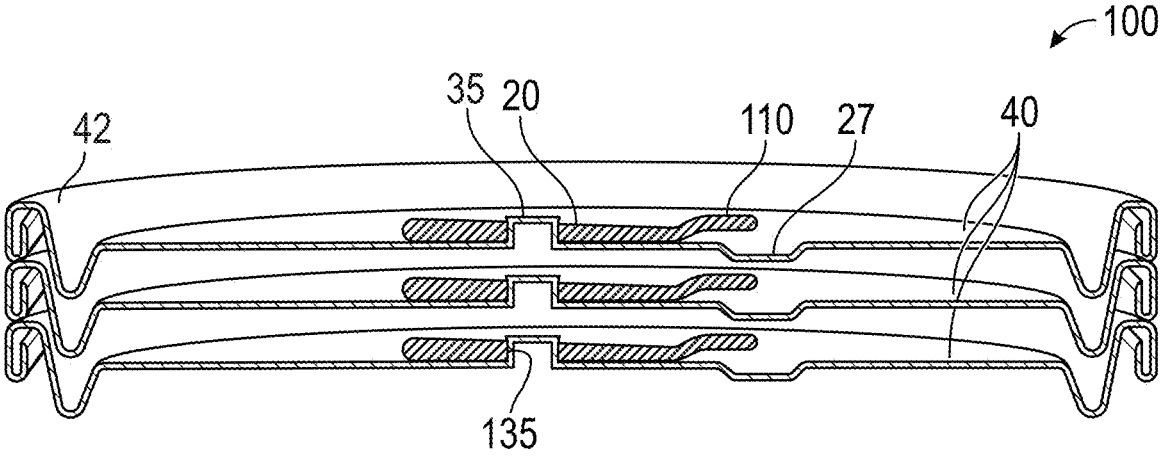
FIG. 8 is a stack of the container lids showing the container lids as being efficiently nestable when the pull tabs are affixed therewith.

At a lift station 160, the pull tab 100 is bent to create deformations at opposing sides 143 of the pull tab 100 such that the lift portion 110 is elevated relative to a top plane $P_1$ of the pull tab 100 (FIG. 7), preferably by a distance $D_1$ of 1 mm-4 mm, or relative to a bottom plane $P_2$ of the pull tab 100, preferably by a distance of 1 mm-6 mm, or at least a distance sufficient to enhance user access while maintaining stacking compatibility, as illustrated in FIG. 8. Stacking compatibility refers to the ability of the container lids 40 to stack tightly on top of one another during manufacturing, shipping, and storage, without creating 'sponginess' between the stacked lids. Rims 42 of the container lids 40 must nestle tightly with those container lids 40 stacked below them. Proper stacking ensures that the stacked container lids 40 occupy a minimum of space within sleeves (not shown) used for transport and manufacturing, preventing issues in storage and shipment.

The carrier strips 75 are then cut from the one or more attachment points 65 of the lift portion 110 of each pull tab 100 to release each pull tab 100 from the carrier sheet 70. A cutting station 200 can be utilized to cut the pull tabs 100 away from the carrier strips 75.

FIG. 3 shows the separated pull tabs 100 as collected into a bin, but such separated pull tabs 100 can also be immediately aligned with and riveted to the container lids 40 with additional manufacturing stations, as is also known in the art.

The tab station 90 may further form a finger hole 150 in each pull tab 100, located in proximity to the lift portion 110. Such a finger hole 150 facilitates user interaction with the pull tab 20 while reducing material needed for each pull tab 100.

At the lift station 160, when bending the pull tab 100 upward, the pull tab 100 may be bent to create deformations or bends 170 at two opposing sides 143 of the pull tab 100 such that the lift portion 110 is elevated above the top plane $P_1$ of the pull tab 100. The lift station 160 may be integrated within a conversion press system, the reform station, or within the tab station 90 (not shown). This integration allows for a more compact manufacturing process. A conversion press system refers to the manufacturing machinery used to stamp metal into specific shapes through multiple stages, such as in the tab die 90. These systems are critical in the production of pull tabs, lids, and cans. The system uses a progressive die to form the pull tab 100 through several steps, each creating a specific feature of the pull tab 100 until the final product is formed.

Alternatively, the lift station 160 may be a modular lift station that can be interchanged with an alternate lift station. Such modularity provides flexibility in the manufacturing process to accommodate different pull tab designs.

At the lift station 160, when bending the pull tab 100 upward, the pull tab 100 may be bent upward at an angle a sufficient to achieve the desired elevation of the lift portion 110. Such an angle a may be between 1 and 80 degrees depending on the intended use, but is preferably between 40 and 50 degrees for aluminum beverage containers 30.

Figure 6:
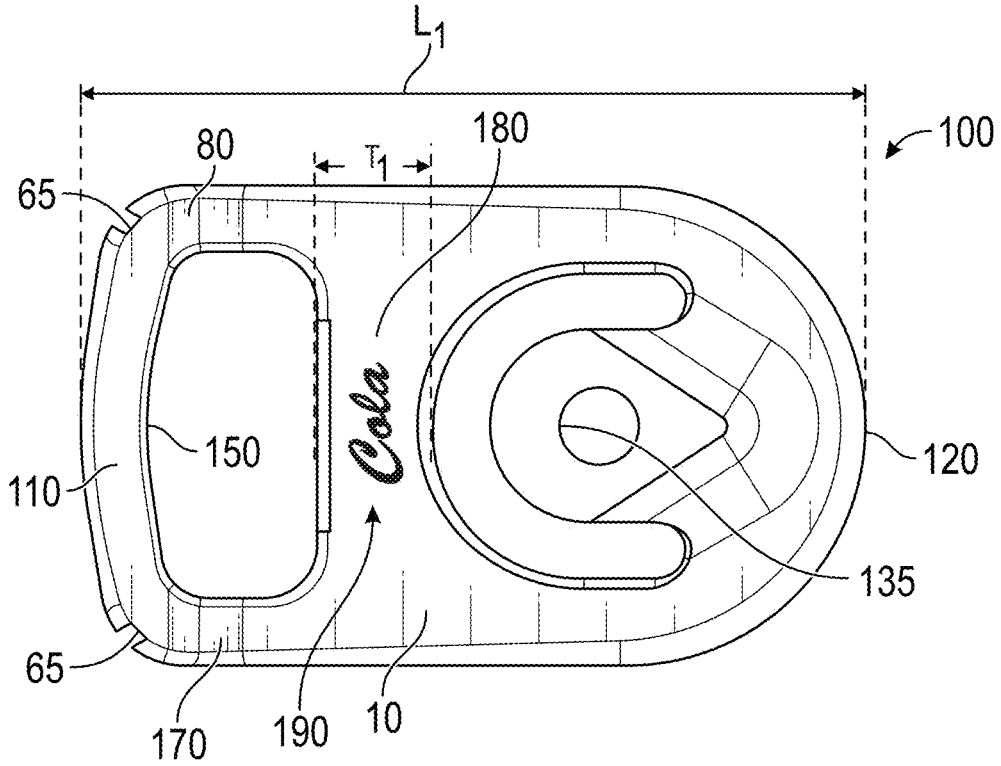
FIG. 6 is a top plan view of an embodiment of the pull tab having a center bar with an indicia applied thereto.

The lift station 160 may create bends 170 in the pull tab 20 at locations that ensure optimal stacking and user access. Such locations may be at a distance $D_2$ between 1 mm and 10 mm from the distal end 148 of the lift portion 110 of the pull tab 20 (FIGS. 6 and 7). An overall length Li of the pull tab 100 is preferably between 20 mm and 25 mm.

At the tab station 90, when forming each tab blank 60 into the pull tab 100, a center bar 180 of the pull tab 20 may be additionally formed. Such a center bar 180 is disposed between the nose 120 and the lift portion 110 and has a thickness $T_1$ of preferably at least 1.9 mm. An indicia 190 (FIG. 6) may be applied to the center bar 180 of the pull tab 20. Such indicia 190 may include branding, instructions, or other relevant information. Promotional material or insignia indicia 190 can be applied to the center bar 180 using methods such as stamping or laser etching. These processes are typically integrated into the manufacturing process, either at a stamping station (not shown) within the conversion press or at an additional laser etching station. This ensures that the indicia 190 is applied consistently across the center bars 180 without interrupting the high-speed manufacturing flow.

Figure 9:
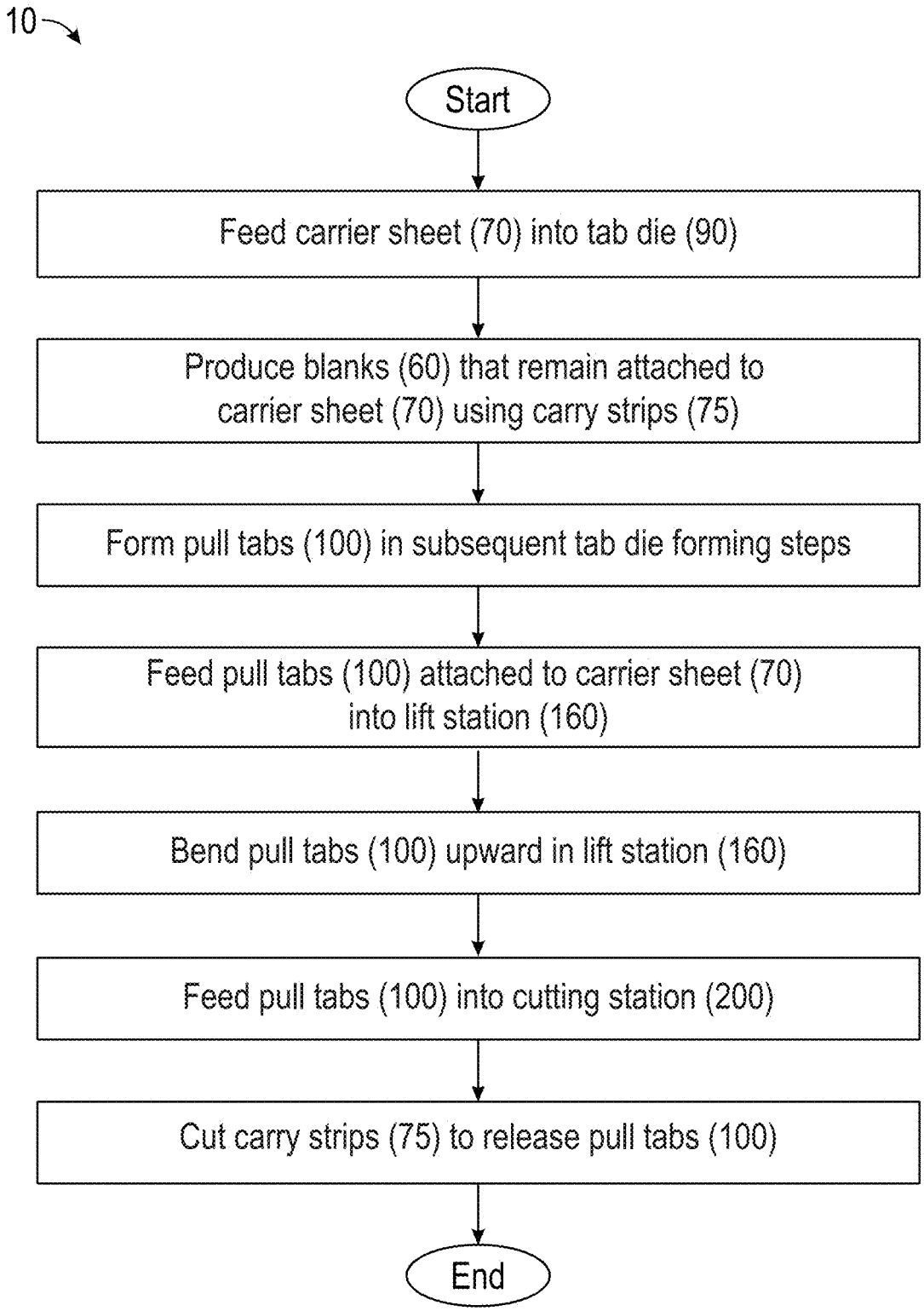
FIG. 9 is a flow chart showing one embodiment of the method of the invention.
Figure 10:
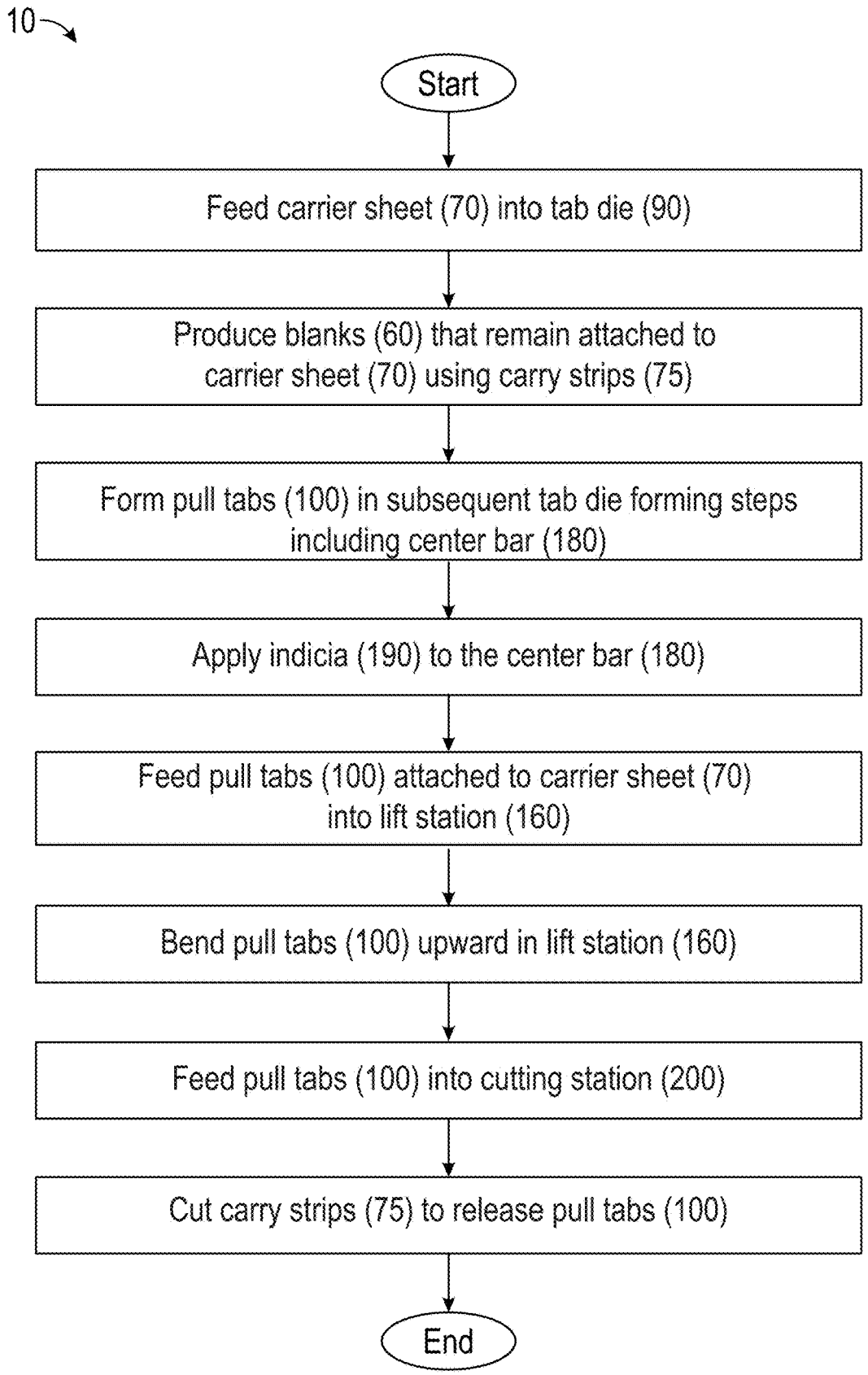
FIG. 10 is a flow chart showing an alternate embodiment of the method of the invention.

The manufacturing process may include additional steps of moving the carrier sheet 70 and the at least one blank 60 to the subsequent tab stations 90, moving the carrier sheet 70 and pull tabs 100 to the lift station 160, and moving the carrier sheet 70 and pull tabs 100 to a cutting station (FIGS. 9 and 10). These movements can be accomplished using progressive die manufacturing processes, or the like, as is known in the art.

The pull tab 20 design, with its raised lift portion 110, enhances user accessibility while ensuring efficient manufacturability. This "ear carry" method 10, utilizing the carrier strips 75 at the attachment points 65 of the lift portion 110, allows for the production of pull tabs 20 with raised lift portions 110 using much of existing progressive die infrastructure, minimizing the need for extensive machine modifications. Positioning the attachment points 65 at or near the lift portion 110 further reduces any consumer interaction while the consumer opens the beverage container 30. The carrier strips 75 stay attached to the carrier sheet 70 (FIG. 6). After the pull tabs 100 are stamped from the carrier sheet 70, the remaining sheet material can be recycled. The greater the amount of material that stays attached to the carrier sheet 70 after the pull tabs 100 are cut, the more efficient the recycling process becomes. This remaining material, commonly known as scrap, is collected and sent for recycling to be repurposed for future use, thereby reducing waste in the manufacturing process.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention. The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A progressive die manufacturing method of producing a pull tab for opening a beverage container of a type having a frangible region of a container lid and a rivet adjacent the frangible region, comprising steps of:

producing at least one tab blank from a carrier sheet, the at least one tab blank fixed with one or more carrier strips of the carrier sheet at one or more attachment points on the pull tab;

at a tab station, forming the at least one tab blank into the pull tab having a nose configured to apply downward pressure on the frangible region of the container lid, a rivet receiving portion adjacent to the nose that includes a rivet aperture therethrough, and a lift portion disposed distally from the nose and terminating at a distal end of the pull tab, each of the one or more attachment points being proximate the lift portion;

at a lift station, bending the pull tab to create deformations such that the lift portion is elevated relative to a top plane of the pull tab; and cutting the one or more carrier strips from the one or more attachment points proximate the lift portion of the pull tab to release the pull tab from the carrier sheet.

2. The progressive die manufacturing method of claim 1 further including the step:

at the tab station, when forming the at least one tab blank into the pull tab, forming in the pull tab a finger hole located in proximity to the lift portion.

3. The progressive die manufacturing method of claim 2 further including the step:

at the lift station, bending the pull tab to create deformations at two opposing sides of the finger hole such that the lift portion is elevated above the top plane of the pull tab by a distance to enhance user access and stacking compatibility.

4. The progressive die manufacturing method of claim 2 further including the step:

at the lift station, bending the pull tab to create deformations such that a topmost point of the lift portion is elevated above a bottom plane of the pull tab by a distance not to exceed 6 mm.

5. The progressive die manufacturing method of claim 1, wherein the lift station is integrated within a conversion press system.

6. The progressive die manufacturing method of claim 1, wherein the lift station is a modular lift station that can be interchanged with an alternate lift station.

7. The progressive die manufacturing method of claim 1 further including the step:

at the lift station, when bending the pull tab to create the deformations, bending the pull tab upward at an angle to achieve a desired elevation of the lift portion.

8. The progressive die manufacturing method of claim 1 further including the step:

at the lift station, when bending the pull tab to create the deformations, bending the pull tab upward at an angle of between 1 and 80 degrees.

9. The progressive die manufacturing method of claim 1 further including the step:

the lift station creating bends in the pull tab at locations on the lift portion for optimal stacking and user access.

10. The progressive die manufacturing method of claim 1 further including the step:

the lift station creating bends in the pull tab between 1 mm and 10 mm from the distal end of the lift portion of the pull tab.

11. The progressive die manufacturing method of claim 1 further including the steps:

at the tab station, when forming the at least one tab blank into the pull tab, forming a center bar of the pull tab disposed between the nose and the lift portion having a thickness of at least 1.9 mm; and applying an indicia to the center bar of the pull tab.

12. A progressive die manufacturing method of producing a pull tab for opening a beverage container of a type having a frangible region of a container lid and a rivet adjacent the frangible region, comprising steps of:

producing at least one tab blank from a carrier sheet, the at least one tab blank fixed with the carrier sheet at one or more attachment points on the pull tab;

at a tab station, forming the at least one tab blank into a pull tab having a nose configured to apply downward pressure on the frangible region of the container lid, a rivet receiving portion adjacent to the nose that includes a rivet aperture therethrough, a lift portion disposed distally from the nose and terminating at a distal end of the pull tab, and a finger hole located in proximity to the lift portion, one or more carrier strips fixed with the pull tab at one or more attachment points proximate the finger hole;

the tab station forming a center bar of the pull tab disposed between the nose and the lift portion with a thickness for structural integrity;

at a lift station, bending the pull tab to create deformations that elevate the lift portion relative to a highest continuous surface that runs along a length of the pull tab from the nose to the lift portion; and cutting the one or more carrier strips from the one or more attachment points of the pull tab to release the pull tab from the carrier sheet.

13. The progressive die manufacturing method of claim 12 further including the step:

at the lift station, bending the pull tab to create the deformations that elevate the lift portion such that the lift portion is elevated above a bottom plane of the pull tab by a distance of 1 mm to 10 mm.

14. The progressive die manufacturing method of claim 12 wherein, at the lift station, when creating bends in the pull tab, each bend at an angle to achieve a desired elevation of the lift portion, the angle being between 1 and 80 degrees.

15. The progressive die manufacturing method of claim 12 wherein, the lift station creates bends in the pull tab between 1 mm and 10 mm from the distal end of the lift portion of the pull tab.

16. The progressive die manufacturing method of claim 12 further including the steps:

moving the carrier sheet and the at least one blank to the tab station;

moving the carrier sheet and pull tabs to the lift station; and moving the carrier sheet and the pull tabs to a cutting station.

17. A progressive die manufacturing method of manufacturing a pull tab for opening a container of a type having a frangible region of a container lid and a rivet adjacent the frangible region, comprising steps of:

producing at least one tab blank from a carrier sheet, the at least one tab blank fixed with the carrier sheet at one or more attachment points on the pull tab;

moving the carrier sheet and the at least one tab blank through a tab station;

at the tab station, forming the at least one tab blank into the pull tab having a nose configured to apply downward pressure on the frangible region of the container lid, a rivet receiving portion adjacent to the nose that includes a rivet aperture therethrough, a lift portion disposed distally from the nose and terminating at a distal end of the pull tab, and a finger hole located in proximity to the lift portion, the one or more carrier strips fixed with the pull tab at one or more attachment points on the lift portion;

the tab station forming a center bar of the pull tab disposed between the nose and the lift portion with a thickness for structural integrity;

moving the carrier sheet and the pull tabs to a lift station;

at the lift station, bending the pull tab to create deformations that elevate the lift portion relative to a top plane of the pull tab, wherein:

the lift station is integrated within the tab station, the lift station creates bends in the pull tab, each bend at an angle to achieve a desired elevation of the lift portion, and the lift station creates bends in the pull tab at a location on the lift portion for optimal stacking and user access;

moving the carrier sheet and the pull tab to a cutting station; and cutting the one or more carrier strips from the one or more attachment points of the pull tab to release the pull tab from the carrier sheet.

18. The progressive die manufacturing method of claim 17 further including the step:

at the lift station, bending the pull tab to create the deformations that elevate the lift portion such that the lift portion is elevated above the top plane of the pull tab by a distance of 1 mm to 4 mm.

19. The progressive die manufacturing method of claim 17, wherein the lift station creates the bends in the pull tab, each bend at the angle to achieve the desired elevation of the lift portion, the angle being between 1 and 80 degrees.

20. The progressive die manufacturing method of claim 17, wherein the lift station creates the bends in the pull tab between 1 mm and 10 mm from the distal end of the lift portion of the pull tab.

* * * * *